US008042754B2

(12) United States Patent
Mähler et al.

(10) Patent No.: US 8,042,754 B2
(45) Date of Patent: Oct. 25, 2011

(54) LABORATORY VIBRATION GRINDING MILL HAVING INCLINED GRINDING BOWLS

(75) Inventors: Stefan Mähler, Velbert (DE); Jürgen Pankratz, Haan (DE)

(73) Assignee: Retsch GmbH (DE)

( * ) Notice: Subject to any disclaimer, the term of this patent is extended or adjusted under 35 U.S.C. 154(b) by 0 days.

(21) Appl. No.: 12/669,152

(22) PCT Filed: Jul. 12, 2008

(86) PCT No.: PCT/EP2008/005707

§ 371 (c)(1),
(2), (4) Date: Jan. 14, 2010

(87) PCT Pub. No.: WO2009/026990

PCT Pub. Date: Mar. 5, 2009

(65) Prior Publication Data

US 2010/0181402 A1 Jul. 22, 2010

(30) Foreign Application Priority Data

Jul. 14, 2007 (DE) ..... 10 2007 032 893

(51) Int. Cl.
*B02C 17/24* (2006.01)

(52) U.S. Cl. ..... 241/175; 241/180

(58) Field of Classification Search ..... 241/175, 241/180

See application file for complete search history.

(56) References Cited

U.S. PATENT DOCUMENTS 4,779,809 A 10/1988 Miwa
5,314,125 A 5/1994 Ohno

FOREIGN PATENT DOCUMENTS

GB 813654 5/1959

OTHER PUBLICATIONS

"Fliehkraft-Kugelmühlen" of F. Kurt Retsch GmbH & Co, KG, Haan from Apr. 1988.

*Primary Examiner* — Mark Rosenbaum

(74) *Attorney, Agent, or Firm* — Robert W. Becker; Robert Becker & Associates

(57) ABSTRACT

A laboratory vibration grinding mill comprising a circular oscillating drive that operates in at least two dimensions, at least one support, and a respective elongated grinding bowl held in each support. The grinding bowl has a filling of grinding bodies and is provided with frontal grinding bowl bases. The support for a grinding bowl is configured such that a longitudinal axis of the grinding bowl forms an angle of less than 90° with a plane of movement of the circular oscillating drive such that due to movement paths of the grinding bodies in the grinding bowl caused by the inclined position of the grinding bowl relative to the plane of movement of the circular oscillating drive, the frontal grinding bowl bases are incorporated into a size-reduction process as abutment and grinding surfaces.

18 Claims, 2 Drawing Sheets

LABORATORY VIBRATION GRINDING MILL HAVING INCLINED GRINDING BOWLS

BACKGROUND OF THE INVENTION

The instant application should be granted the priority dates of Jul. 14, 2007, the filing date of the corresponding German patent application 10 2007 032 893.3, as well as Jul. 12, 2008, the filing date of the International patent application PCT/EP2008/005707.

The present invention relates to a laboratory vibration grinding mill having a circular oscillating drive that operates in at least two dimensions, and also having at least one support for an elongated grinding bowl that is held therein, has a filling of grinding bodies, and is IS provided with frontal grinding bowl bases.

A laboratory vibration grinding mill having the aforementioned features is known in one structure as a planetary ball mill having a speed ratio k=1:−1 from the company brochure "Fliehkraft-Kugelmühlen" of F. Kurt Retsch GmbH & Co. KG, Haan from Apr. 1988. With such laboratory vibration grinding mills, which have a circular oscillating drive that operates in two dimensions, the grinding bodies, which are preferably embodied as balls, are pressed against the outer wall of the grinding bowls due to the high centrifugal forces that are active, where they reduce the size of the material to be ground between them and the grinding bowl wall due to rolling pressure and frictional effect. Cylindrical grinding bowls are used as grinding bowls that by means of the grinding bowl support that is provided on the laboratory vibration grinding mill are held in a perpendicular orientation of their longitudinal axis relative to the plane of the two-dimensional circular vibrational movement in the laboratory vibration grinding mill. To improve the grinding result, it is additionally known to design the speed ratio of a planetary ball mill to k>1, so that during the grinding process, the grinding bodies depart from the wall of the grinding bowl and fly through the grinding bowl along a secant-shaped movement line, and strike a region of the wall of the grinding bowl that is opposite the point of departure, so that the size reduction is additionally improved by rebound or impact load.

The object of the present invention, for a laboratory vibration grinding mill having the aforementioned features, is to increase the energy input during the grinding process and to thus improve the overall grinding result.

SUMMARY OF THE INVENTION

The basic concept of the invention is that the support for the grinding bowl is configured such that the longitudinal axis of the grinding bowl forms an angle of less than 90° with a plane of movement of the circular oscillating drive such that due to movement paths of the grinding bodies in the grinding bowls caused by the inclined position of the grinding bowl relative to the plane of movement of the circular oscillating drive, the frontal grinding bowl bases are incorporated into the size-reduction process as abutment and grinding surfaces. The invention has the advantage that on the one hand during the grinding process a periodic movement component acts upon the grinding bodies in the direction of the outer wall of the grinding bowl, while on the other hand due to the inclined position of the grinding bowl relative to the movement plane of the circular oscillating drive, another, further movement component acts upon the grinding bodies in the direction of the longitudinal axis of the grinding bowl. As a result, during the movement of the grinding bodies against the outer wall of the grinding bowl, a predominantly frictional loading is achieved, and when the grinding bodies strike against the frontal grinding bowl bases, a rebound loading of the material that is to be ground is effected. At the same time, due to the movement of the grinding bodies in the longitudinal direction of the grinding chamber, the material that is to be ground is also better intermixed, so that all of the particles of the material that is to be ground are loaded or exposed simultaneously, thus increasing the efficiency of the size reduction.

Pursuant to embodiments of the invention, the angle that exists between the longitudinal axis of the grinding bowl and the movement plane of the circular oscillating drive can be less than 80°, preferably less than 60°; in this connection, the angle can also be reduced to 0°, so that the longitudinal axis of the grinding bowl can coincide with the movement plane of the circular oscillating drive.

Pursuant to one embodiment of the invention, for the further improvement of the efficiency of the size reduction, there is provided a three-dimensionally acting drive having an additional movement component that acts upon the grinding bowl perpendicular to the plane of the circular oscillating movement. In this way, the movement component acting upon the grinding bodies is reinforced in the direction toward the grinding bowl bases. To the extent that the longitudinal axis of the grinding bowl is to form an angle with the movement plane of the circular oscillating drive, with a three-dimensionally acting drive two of the movement directions of the three-dimensional excitation can form a movement plane as a reference for the inclined position of the grinding bowl.

To obtain an optimum grinding result with as high an end fineness of the material that is to be ground as possible, pursuant to one embodiment the length of the grinding bowl is to be coordinated with the vibration intensity, which is defined by the vibration amplitude of the drive and its frequency, whereby the length of the grinding bowl is in particular to be measured such that the kinetic energy of the grinding bodies impacting the frontal grinding bowl bases is at a maximum. The ratio of the vibration amplitude of the drive to the length of the grinding bowl, depending upon the size of the grinding bodies utilized, is preferably between 0.3 and 1.6.

Pursuant to one embodiment of the invention, the drive has adjustable vibration frequencies. Furthermore, the drive can have adjustable vibration amplitudes. With regard to the configuration of a circular oscillating drive, pursuant to one embodiment of the invention, the drive is embodied as a planetary drive having a gear ratio k=1:−1, as such a drive is known from the aforementioned state of the art.

However, the invention can also be used with other types of circular oscillating drives. For example, pursuant to one embodiment of the invention, the drive is provided as an unbalanced type vibratory or oscillating drive.

Furthermore, pursuant to alternative embodiments of the invention, the drive can be embodied as a cyclically operating or as a non-cyclically operating oscillatory drive.

In a manner known per se, the grinding bodies can be embodied as balls.

Pursuant to one embodiment of the invention, the greatest distance between two oppositely disposed wall regions, which determine the cross-section of the grinding bowl, can be less than the length of the grinding bowl determined perpendicular to the cross-sectional area.

To the extent that the invention relates to the use of elongated grinding bowls having respectively arranged frontal grinding bowl bases, the use of the invention for grinding bowls that are rotationally symmetrical all the way around is not expedient. For example, the length prescribed by the lengthwise extension of the grinding bowl, and hence the distance between the grinding bowl bases, must in any case be greater than the diameter of the region disposed between the grinding bowl bases. Within this framework, the invention can be realized with various grinding bowl shapes. For example, the grinding bowl can have a circular cross-section or an elliptical cross-section or an angular cross-section with rounded corner regions, whereby with the last mentioned embodiment, the rounded corner regions of the grinding bowl have a radius corresponding to the radius of the grinding bodies. Other grinding bowl shapes are also possible.

Furthermore, the frontal or end face grinding bowl bases of the grinding bowl can have a planar configuration, so that, for example with grinding bowls having a circular cross-section, a cylindrical configuration of the grinding bowls results. Alternatively, the frontal grinding bowl bases of the grinding bowl can have a cup-shaped configuration.

It is to be understood that with realization of the invention, a plurality of grinding bowls can be held in a laboratory vibration grinding mill in a known manner.

BRIEF DESCRIPTION OF THE DRAWINGS

Embodiments of the invention, which will be described subsequently, are shown in the drawings, in which.

DESCRIPTION OF SPECIFIC EMBODIMENTS

Figure 1:
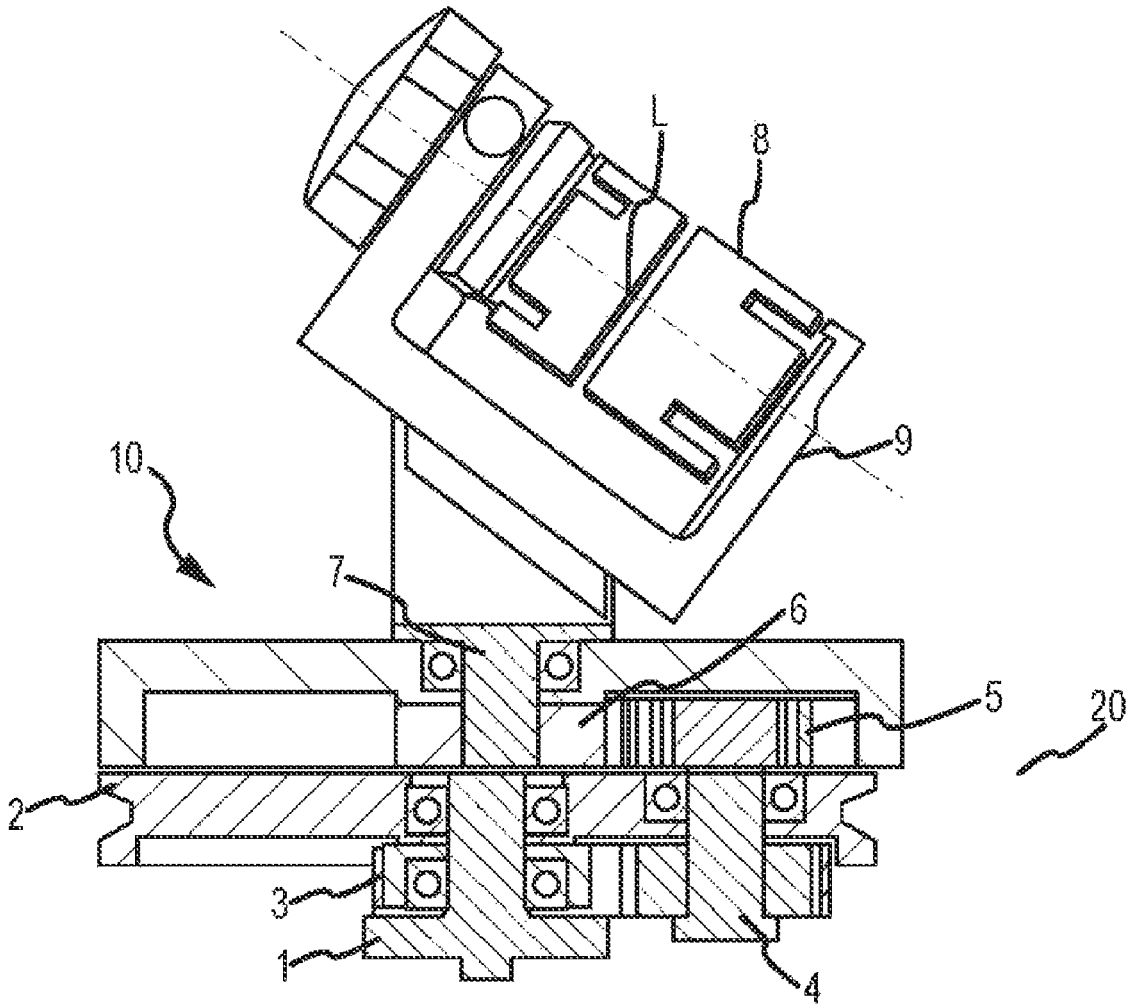
FIG. 1: is a partially sectioned side view of a laboratory vibration grinding mill that is provided with a planetary drive and has an inclined grinding bowl.

With the laboratory vibration-grinding mill or ball mill that is schematically shown in FIG. 1 in an illustration limited to the drive 10 with the grinding bowl support, the rotational movement of the sun wheel 2, which is rotatably mounted on the sun wheel shaft 1, effects, via the belt drive 3, a rotation of the intermediate shaft 4. The gear wheel 5 is fixedly connected with this intermediate shaft 4 and drives the planetary shaft 7 via the further gear wheel 6. A grinding bowl or cup 8, at an angle to the movement plane 20 of the circular oscillating drive, is held or secured in the grinding bowl support 9, which is connected with the planetary shaft. The grinding bowl 8 rotates in the ratio 1:−1 relative to the rotation of the sun wheel 2, so that a rotational circular movement is established. Due to the inclined positioning of the grinding bowl 8 in relationship to the movement plane 20 of the circular oscillating drive, the frontal grinding bowl bases of the grinding bowl 8 are incorporated into the grinding or milling process as abutment and grinding surfaces.

Figure 2:
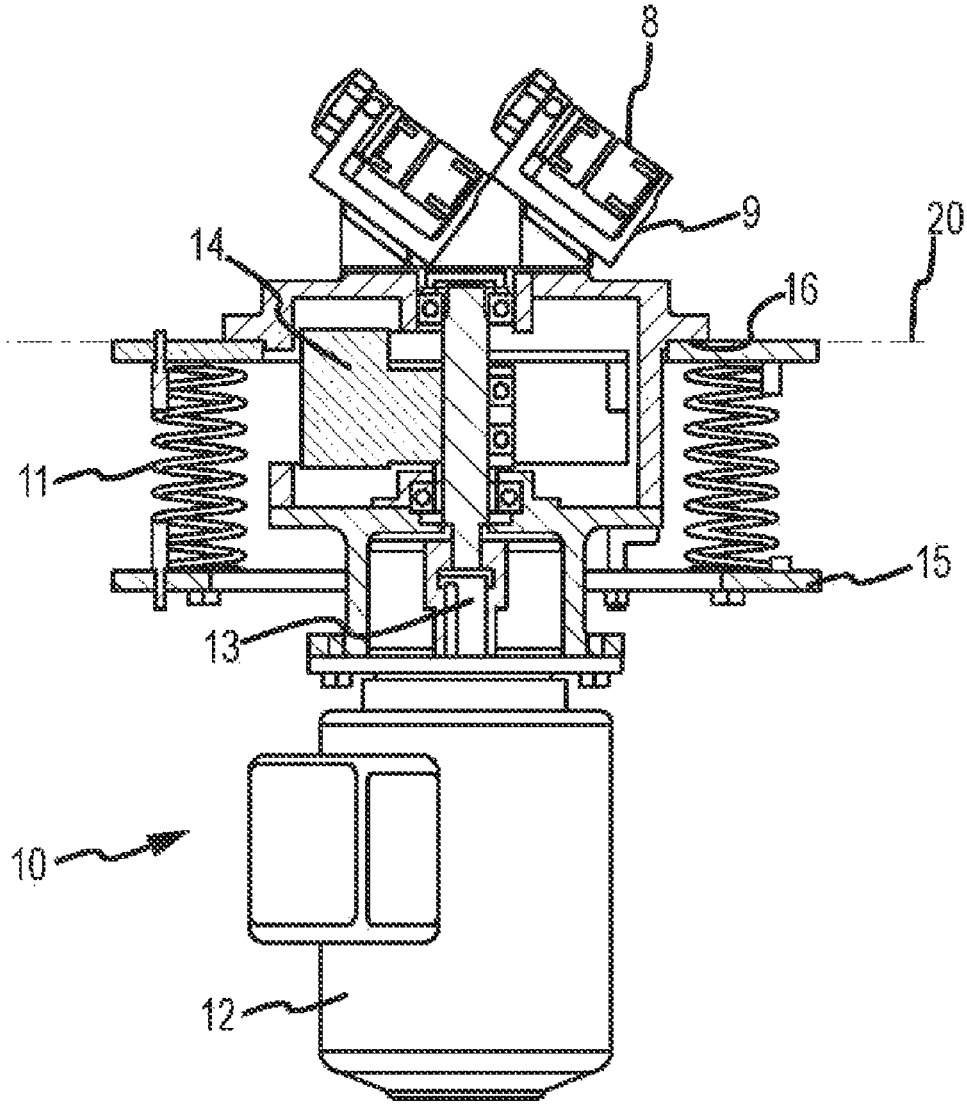
FIG. 2: is a laboratory vibration grinding mill in an illustration pursuant to FIG. 1 that has an unbalanced type vibratory drive.

The embodiment illustrated in FIG. 2 shows the laboratory vibration grinding mill with a drive 10 configured as an unbalanced type vibratory drive. The drive 10 is supported via springs 11 on a stationary base plate 15. The drive 10 is comprised of the drive motor 12, the drive shaft 13, and the unbalanced mass 14, and produces a speed-dependent, circumferential or rotational horizontal force. This force excites the spring-suspended mass vibrator, comprised of the drive 10 with the mounting plate 16, the useful load, in the form of two grinding bowl supports 9 with grinding bowls 8 held therein, mounted on the mounting plate, as well as the springs 11, in two dimensions, resulting in a rotational circular movement in the movement plane 20. The two grinding bowl supports 9 move in common on this circular path together with the mounting bowls 8 held therein.

Although not further illustrated, it can also be provided that the drive produces an additional movement component, perpendicular to the plane 20 of the circular vibratory movement, that acts upon the grinding bowl 8, so that the drive is appropriately designed with a three-dimensional action.

The features of the subject matter of these documents disclosed in the preceding description, the patent claims, the abstract and the drawings can be important individually as well as in any desired combination with one another for realizing the various embodiments of the invention.

The specification incorporates by reference the disclosure of German application 10 2007 032 893.3 filed Jul. 14. 2007, as well as International application PCT/EP2008/005707 filed Jul. 12 2008.

The present invention is, of course, in no way restricted to the specific disclosure of the specification and drawings, but also encompasses any modifications within the scope of the appended claims.

The invention claimed is:

1. A laboratory vibration grinding mill, comprising:

a circular oscillating drive that operates in at least two dimensions;

at least one support; and a respective elongated grinding bowl held in each support, wherein said grinding bowl has a filling of grinding bodies and is provided with frontal grinding bowl bases, and wherein said grinding bowl is configured such that a longitudinal axis of said grinding bowl forms an angle of not more than 60° with a plane of movement of said circular oscillating drive and such that a length of said grinding bowl is coordinated with a vibration intensity, which is defined by the vibration amplitude of said drive and its frequency, such that due to movement paths of said grinding bodies in said grinding bowl caused by the inclined position of said grinding bowl relative to said plane of movement of said circular oscillating drive, said frontal grinding bowl bases are incorporated into a size-reduction process as abutment and grinding surfaces.

2. A laboratory vibration grinding mill according to claim 1, which includes a three-dimensionally operating drive having an additional movement component that acts upon said grinding bowl perpendicular to said plane of movement.

3. A laboratory vibration grinding mill according to claim 1, wherein by setting the vibration intensity, the length of said grinding bowl is such that the kinetic energy of said grinding bodies that impact said frontal grinding bowl bases is at a maximum.

4. A laboratory vibration grinding mill according to claim 3, wherein the ratio of the vibration amplitude of said drive to the length of said grinding bowl is between 0.3 and 1.6.

5. A laboratory vibration grinding mill according to claim 1, wherein said drive has adjustable vibration frequencies.

6. A laboratory vibration grinding mill according to claim 1, wherein said drive has adjustable vibration amplitudes.

7. A laboratory vibration grinding mill according to claim 1, wherein said drive is embodied as a planetary drive having a gear ratio k=1:-1.

8. A laboratory vibration grinding mill according to claim 1, wherein said drive is embodied as an unbalanced type vibratory or oscillating drive.

9. A laboratory vibration grinding mill according to claim 1, wherein said drive is embodied as a cyclically operating oscillating drive.

10. A laboratory vibration grinding mill according to claim 1, wherein said drive ,is embodied as a non-cyclically operating oscillating drive.

11. A laboratory vibration grinding mill according to claim 1, wherein said grinding bodies are embodied as balls.

12. A laboratory vibration grinding mill according to claim 1, wherein the greatest distance between two oppositely disposed wall regions of said grinding bowl, which determines the cross-section of said grinding bowl, is less than the length of said grinding bowl determined perpendicular to the cross-sectional area.

13. A laboratory vibration grinding mill according to claim 1, wherein said grinding bowl has a circular cross-section.

14. A laboratory vibration grinding mill according to claim 1, wherein said grinding bowl has an elliptical cross-section.

15. A laboratory vibration grinding mill according to claim 1, wherein said grinding bowl has an angular cross-section with rounded corner regions.

16. A laboratory vibration grinding mill according to claim 15, wherein said rounded corner regions of said grinding bowl have a radius corresponding to a radius of said grinding bodies.

17. A laboratory vibration grinding mill according to claim 1, wherein said frontal grinding bowl bases of said grinding bowl have a planar configuration.

18. A laboratory vibration grinding mill according to claim 1, wherein said frontal grinding bowl bases of said grinding bowl have a cup-shaped configuration.

* * * * *